US010159860B2

(12) United States Patent
Yoshioka

(10) Patent No.: US 10,159,860 B2
(45) Date of Patent: Dec. 25, 2018

(54) ARTICLE TRANSPORT FACILITY

(71) Applicant: Daifuku Co., Ltd., Osaka-shi (JP)

(72) Inventor: Hideo Yoshioka, Shiga (JP)

(73) Assignee: Daifuku Co., Ltd., Osaka-shi (JP)

( * ) Notice: Subject to any disclaimer, the term of this patent is extended or adjusted under 35 U.S.C. 154(b) by 354 days.

(21) Appl. No.: 15/005,251

(22) Filed: Jan. 25, 2016

(65) Prior Publication Data

US 2016/0214831 A1 Jul. 28, 2016

(30) Foreign Application Priority Data

Jan. 27, 2015 (JP) ..... 2015-013469

(51) Int. Cl.

| | |
|---|---|
| ***A62C 2/00*** | (2006.01) |
| ***A62C 2/06*** | (2006.01) |
| ***B66B 5/02*** | (2006.01) |
| ***A62C 99/00*** | (2010.01) |

(52) U.S. Cl.

CPC ..... *A62C 2/00* (2013.01); *A62C 2/06* (2013.01); *A62C 2/065* (2013.01); *A62C 99/0018* (2013.01); *B66B 5/024* (2013.01)

(58) Field of Classification Search

CPC ..... A62C 2/00; A62C 2/06; A62C 99/0018; A62C 3/00; A62C 3/002; A62C 3/004; A62C 2/10; A62C 2/065; A62C 2/22; B66B 5/024; E04B 1/94; E05Y 2900/134; E06B 5/16

USPC ..... 52/30; 169/48

See application file for complete search history.

(56) References Cited

U.S. PATENT DOCUMENTS

2002/0032991 A1* 3/2002 James, Jr. ..... A62C 2/22 52/30

FOREIGN PATENT DOCUMENTS

| | | |
|---|---|---|
| JP | 5012593 U | 2/1975 |
| JP | 51130700 U | 10/1976 |
| JP | 672657 A | 3/1994 |
| JP | 2009137675 A | 6/2009 |

* cited by examiner

*Primary Examiner* — Darren W Gorman
*Assistant Examiner* — Juan C Barrera
(74) *Attorney, Agent, or Firm* — The Webb Law Firm

(57) ABSTRACT

An article transport facility is provided in which, when a fire breaks out on a floor below, smoke etc. can be prevented from entering floors above through an opening. An opening, which a raised and lowered member can move through in a vertical direction, is formed in an intermediate floor portion located between the floor above and the floor below. A fire door for opening and closing the opening is provided. A gas ejection device having an ejecting portion for ejecting gas is provided at a lower position than the fire door. The ejecting portion ejects gas horizontally toward an area directly below a gap formed at an edge of the fire door when the opening is closed by the fire door.

15 Claims, 7 Drawing Sheets

ARTICLE TRANSPORT FACILITY

CROSS-REFERENCE TO RELATED APPLICATION

This application claims priority to Japanese Patent Application No. 2015-013469 filed Jan. 27, 2015, the disclosure of which is hereby incorporated in its entirety by reference.

FIELD OF THE INVENTION

The present invention relates to an article transport facility with a fire door.

BACKGROUND

An article transport facility provided with an article transport device which raises and lowers, through a plurality of floors, an raised and lowered member supporting an article is described in JP Publication of Application No. 2009-137675 (Patent Document 1). This article transport facility has an opening which is formed in the floor portion between a floor above and a floor below, and through which the raised and lowered member can move through along the vertical direction. In addition, this article transport facility is provided with a fire door which opens and closes this opening. In other words, the article transport facility of Patent Document 1 is configured, when a fire breaks out in the floor below, to prevent the flames, smoke, and hot air generated by the fire (referred to hereinafter as "hot air, etc.") from entering the floor above through the opening, by closing the opening with the fire door.

Incidentally, in article transport facilities such as one just described, gaps are often formed at an edge of the fire door even when the opening is closed by the fire door. Especially when installed objects having complex shapes, such as a guide rail for guiding the raised and lowered member or a power supply cable for supplying electric power to the raised and lowered member, exist in the opening of the floor, it is difficult to match the shape of an edge of the fire door with the shapes of such installed objects. For this reason, when the opening is closed by the fire door, gaps tend to be formed between edges of the fire door and the installed objects.

With such gaps formed, when a fire breaks out on the floor below, there is a possibility that the flames and smoke, etc. generated by the fire may enter the floor above through the gaps formed at the edges of the fire door. As a solution to this, it is conceivable to provide expanding members, which expand when heated, at locations in which the gaps are formed. That is, it is conceivable to close the gaps with the expanding members expanded by the heat generated by the fire. Thus, flames, smoke, etc. can be prevented from entering the floor above by closing the gaps in this manner; however, there will be a time lag between the time a fire breaks out and the time the expanding members expand to close the gaps. Therefore, there is a possibility that smoke etc. may enter the floor above through the gaps by the time the expanding members have expanded to close the gaps.

SUMMARY OF THE INVENTION

Thus, an article transport facility is desired in which, when a fire breaks out on a floor below, smoke etc. can be prevented from entering a floor above through any gap formed at an edge of the fire door.

In one embodiment, an article transport facility comprises: an article transport device for raising and lowering a raised and lowered member for supporting an article, through a plurality of floors; an opening which is formed in an intermediate floor portion, and which the raised and lowered member can move through in a vertical direction, the intermediate floor portion being a floor portion located between an uppermost floor and a lowermost floor of the plurality of floors; a fire door for opening and closing the opening; and a gas ejection device having an ejecting portion for ejecting gas; wherein the gas ejection device is provided at a lower position than the fire door, and wherein the ejecting portion ejects gas horizontally toward an area directly below a gap formed at an edge of the fire door when the opening is closed by the fire door.

With the arrangement described above, the gas ejected by the ejecting portion is ejected horizontally toward an area directly below the gap formed at an edge of the fire door. And the flow of gas ejected by the ejecting portion makes it difficult for the smoke etc. to raise above the area of the flow of gas; thus, smoke etc. can be prevented from entering the floor above through the gap located directly above the flow of gas. Note that in order to prevent the rise of smoke etc. effectively, it is preferable that the strength of the flow (of gas ejected from the gas ejection device) in the area directly below the gap is greater than the strength of the flow of rising flow caused by the smoke etc.

Additional features and advantages of the article transport facility will become clear from the following descriptions of the embodiments described with reference to the attached drawings.

DETAILED DESCRIPTION

Figure 1:
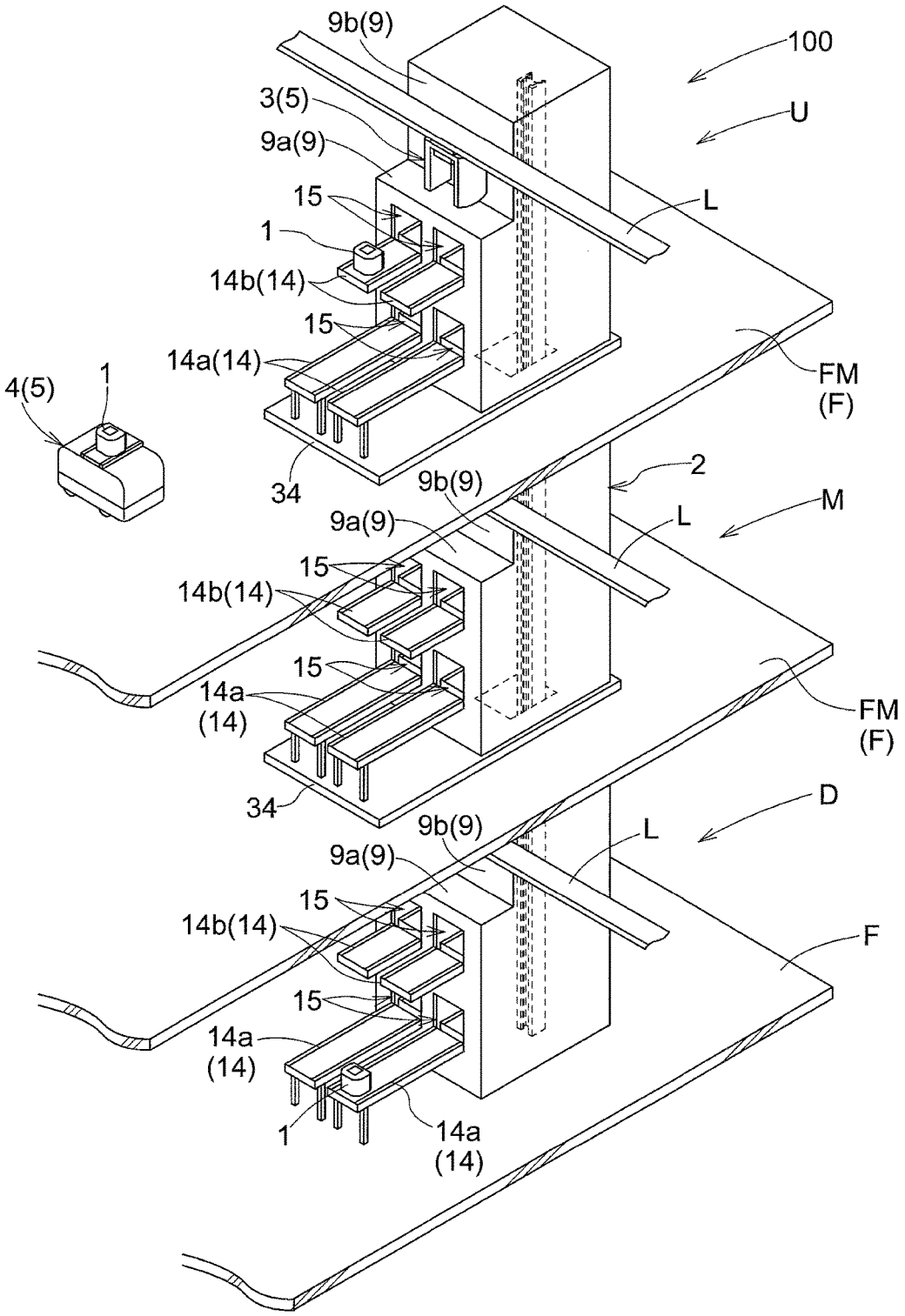
FIG. 1 is a perspective view of a principal portion of an article transport facility.

Embodiments of the present invention are described next with reference to the drawings. As shown in FIG. 1, an article transport facility 100 includes a raising and lowering transport device 2 for transporting articles 1, one article 1 at a time, among and through a plurality of floors, one or more ceiling, or overhead, transport vehicles 3 which are provided on each of the plurality of floors or levels and each of which is configured to travel near the ceiling to transport articles 1, one article 1 at a time, and one or more floor transport vehicles 4 which are provided on each of the plurality of floors and each of which is configured to travel on the floor. The raising and lowering transport device 2 is an article transport device for raising and lowering, or vertically moving, a raised and lowered member 6 between an upper floor U and a lower floor D. In addition, in the present embodiment, a FOUP (Front Opening Unified Pod) for holding, or carrying, semiconductor substrates is illustrated as an example of the article 1.

In the present embodiment, an example is described in which the article transport facility 100 is a three-story structure having the upper floor U, an intermediate floor M, and the lower floor D. The article transport facility 100 may be a two-story structure, or a structure having four or more floors or levels. In case of a two-story structure, there would be no intermediate floor M, and the structure would consist of the upper floor U and the lower floor D. When the article transport facility 100 is a structure having four or more floors, the upper floor U in the description that follows is, or corresponds to, the uppermost floor whereas the lower floor D is, or corresponds to, the bottom or the lowermost floor. In addition, each of the plurality of floors between the uppermost floor and the lowermost floor is, or corresponds to, an intermediate floor M.

Figure 2:
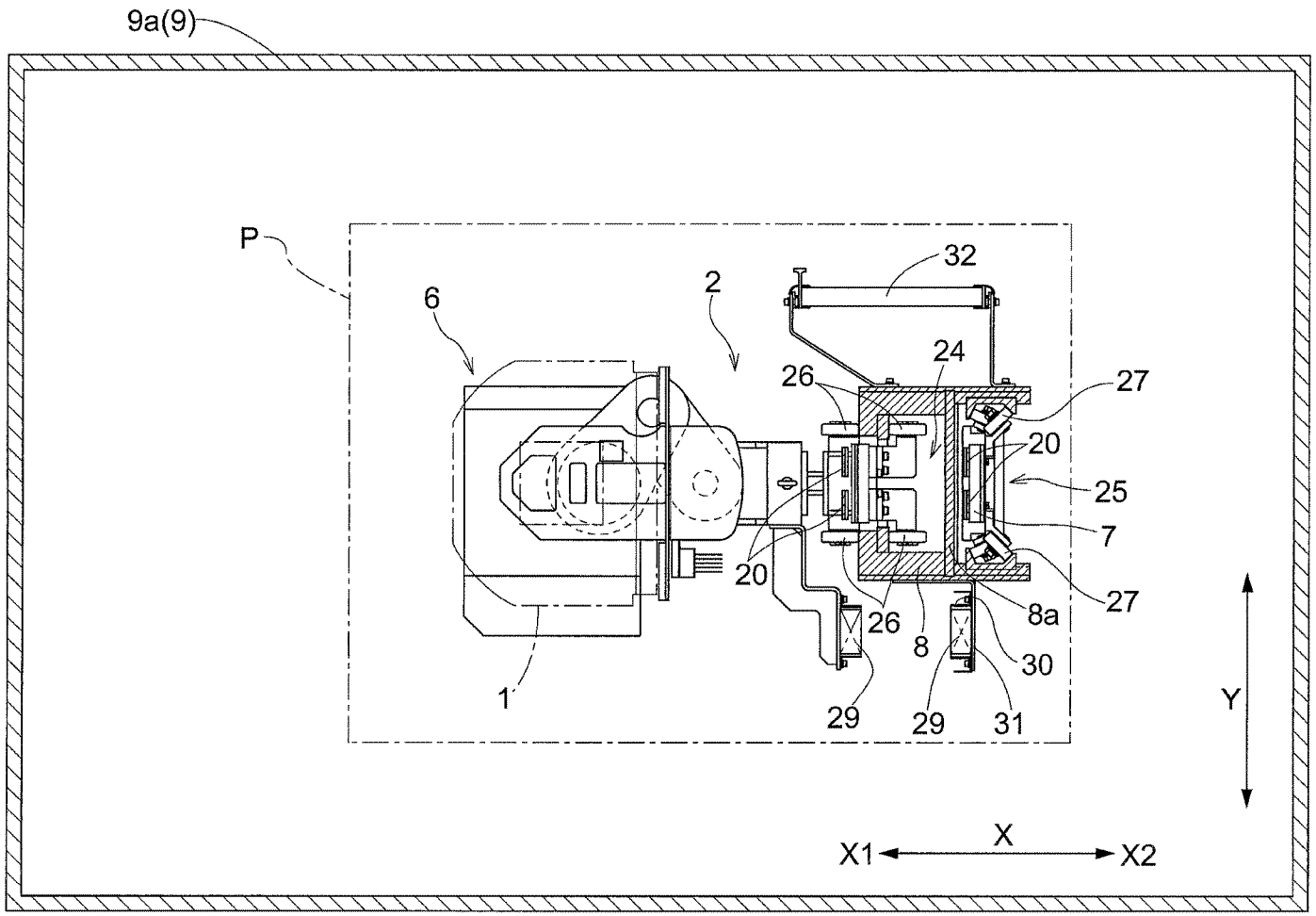
FIG. 2 is a cross-sectional view showing a raising and lowering transport device.

As shown in FIG. 2, the raising and lowering transport device 2 includes the raised and lowered member 6 for supporting an article 1, a balance weight, or counter weight 7, connected to the raised and lowered member 6, and a guide rail 8 made of steel for guiding the raised and lowered member 6 and the balance weight 7, along a vertical direction as they are raised and lowered. As shown in FIG. 1, a floor portion F of the upper floor U and a floor portion F of the intermediate floor M are located between the upper floor U and the lower floor D. When these floor portions F need to be distinguished from the floor portion F of the lower floor D (the lowermost floor), they will be referred to as intermediate floor portions FM. As shown in FIG. 2, an opening P, through which the raised and lowered member 6 and the balance weight 7 can move along the vertical direction, is formed in each of the floor portions F (intermediate floor portions FM) located between the upper floor U and the lower floor D. As described in more detail below, fire doors 34, each of which can open and close the corresponding opening P when a fire etc. breaks out, are provided in the article transport facility 100. The guide rail 8 extends through the openings P, into the upper floor U and the lower floor D through the intermediate floor M.

Note that the floor portion F of the floor for which another floor exists below may serve as the ceiling of the floor immediately below. For example, the floor portion F of the upper floor U may serve as the ceiling of the intermediate floor M. In addition, the floor portion F of the intermediate floor M may serve as the ceiling of the lower floor D. In other words, each of one or more intermediate floor portions FM may serve as the ceiling of the floor immediately below.

In addition, in the following description, a "floor above" refers to a floor that is at a higher level than a "subject floor" on which, for example, a fire, etc. has broken out, or a floor that is at a higher level than a "subject floor portion" which is the floor portion F (intermediate floor portion FM) in which its fire door 34 ("the subject fire door") is closed in response to a fire etc. is installed. In addition, the concept of a "floor below" is opposite from the concept of a "floor above". And a "floor below" refers to a floor that is at a lower level than a floor above, or a floor that is at a lower level than a floor on which a fire has broken out, or than a subject floor portion described above. Therefore, the uppermost floor (upper floor U) is basically a "floor above", whereas the lowermost floor (lower floor D) is basically a "floor below". An intermediate floor M may be either a "floor above" or a "floor below" depending on a specific situation. For example, when a fire etc. break out on one of the intermediate floors M, one or more floors (other intermediate floor(s) M and a lower floor D) located below the intermediate floor M are "floors below" the intermediate floor M in question. And one or more floors (the remaining of the intermediate floor(s) M and the upper floor U) located above the intermediate floor M in question are "floors above" the intermediate floor M in question.

On each floor, one or more ceiling transport vehicles 3 and one or more floor transport vehicles 4 are utilized as article transport vehicles 5 for transporting articles 1. Each ceiling transport vehicle 3 is an article transport vehicle 5 which is suspended from and supported by travel rails L installed to, and suspended from, the ceiling of each floor, and travels along the travel rails L. Each floor transport vehicle 4 is an article transport vehicle 5 which travels on the floor portion, or surface, F of each floor.

As shown in FIG. 1, the article transport facility 100 includes a hollow, tubular member 9 which is provided to extend from the upper floor U through the lower floor D and which forms or defines a raising and lowering path along which the raised and lowered member 6 is raised and lowered. This tubular member 9 is formed to have a shape that surrounds the raising and lowering path in which the raised and lowered member 6 is raised and lowered. And formed in the tubular member 9 are access openings 15 provided for each of the upper floor U, the intermediate floor M, and the lower floor D for transferring articles 1 between a given floor and the raised and lowered member 6.

The tubular member 9 consists of sections with each section being provided for the corresponding floor. The tubular member 9 in the present embodiment is divided into three sections with a section provided to the upper floor U, a section provided to the intermediate floor M, and a section provided to the lower floor D. Each of the divided sections is formed to have a shape of a tube (with rectangular cross-sections) extending along the vertical direction so as to form within it the raising and lowering path for the raised and lowered member 6. As shown in FIG. 1, each section of the tubular member 9 includes a broad portion 9*a* whose horizontal area is relatively large and a narrow portion 9*b* whose horizontal area is relatively small. More specifically, the narrow portion 9*b* is formed to have such dimensions that its cross-sectional area is larger than the area of the opening P. And the broad portion 9*a* is formed to have such dimensions that its cross-sectional area is larger than the cross-sectional area of the narrow portion 9*b*. The broad portion 9*a* is provided on the floor portion F side in the floor whereas the narrow portion 9*b* is provided on the side opposite from, or away from, the floor portion F in the floor. On each floor, the tubular member 9 (i.e. each section thereof) is formed such that the narrow portion 9*b* rests on top of the broad portion 9*a*.

Figure 3:
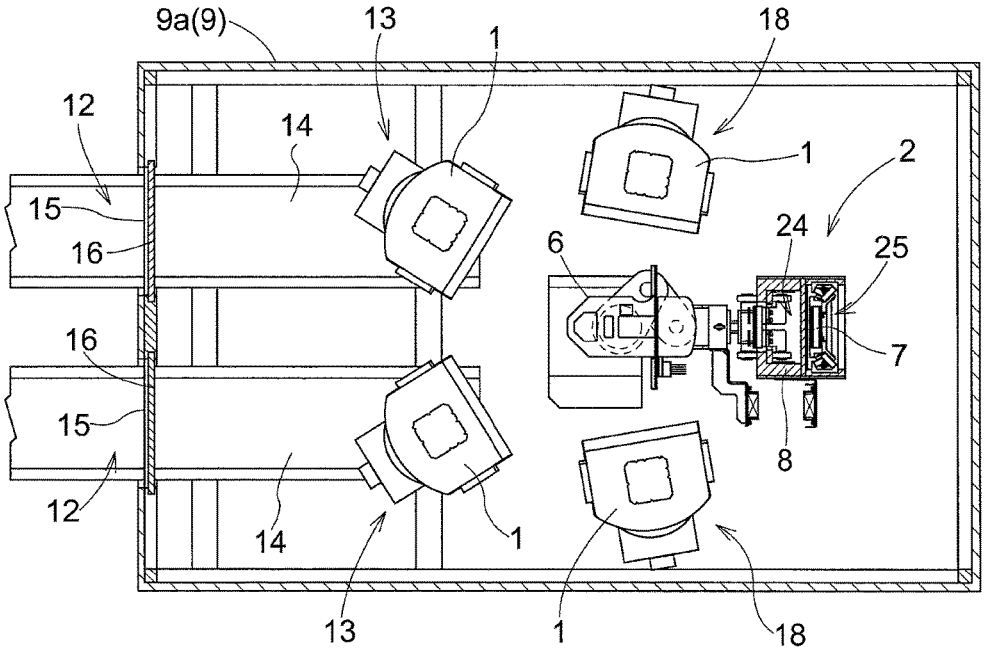
FIG. 3 is a cross-sectional view showing the raising and lowering transport device and a broad portion of a tubular member.

As shown in FIGS. 1 and 3, transport conveyors 14 for supporting and transporting articles 1 are provided to each broad portion 9*a* of the tubular member 9. Each transport conveyor 14 is provided such that it extends from the tubular member 9 to its outside to support and transport articles 1 between the area inside and the area outside of the tubular member 9. Within the tubular member 9, each transport conveyor 14 supports and transports articles 1 between an outside location 12 located outside of the tubular member 9 and an inside location 13 located on the inside of the tubular member 9. In the present embodiment, two levels of transport conveyors 14 (14*a*, 14*b*) are provided for each floor with the each level spaced part from the other in the up and down, or vertical, direction. First transport conveyors 14*a* are provided closer to the floor portion F whereas second transport conveyors 14*b* are provided at a higher location from the floor portion F than the first transport conveyors 14*a*. In the following description, when there is no need to distinguish between first transport conveyors 14*a* and second transport conveyors 14*b*, they will be referred to simply as transport conveyors 14.

The ceiling transport vehicle 3 transfers articles 1 to and from the outside locations 12 of the second transport conveyors 14*b* installed at the higher location whereas the floor transport vehicle 4 transfers articles 1 to and from the outside locations 12 of the first transport conveyors 14*a* installed at the lower location. In addition, the raising and lowering transport device 2 transfers articles 1 to and from the inside locations 13 of the first transport conveyors 14*a* as well as to and from the inside locations 13 of the second transport conveyors 14*b*.

As described above, each transport conveyor 14 is provided such that it extends from within the tubular member 9 to its outside. Thus, access openings 15 for allowing articles 1 placed on the transport conveyors 14 to pass through, when transporting the articles 1 between the inside and outside of the tubular member 9, are formed in a wall of the tubular member 9. In addition, opening and closing doors 16 for opening and closing respective access openings 15 are also provided to the tubular member 9.

Figure 4:
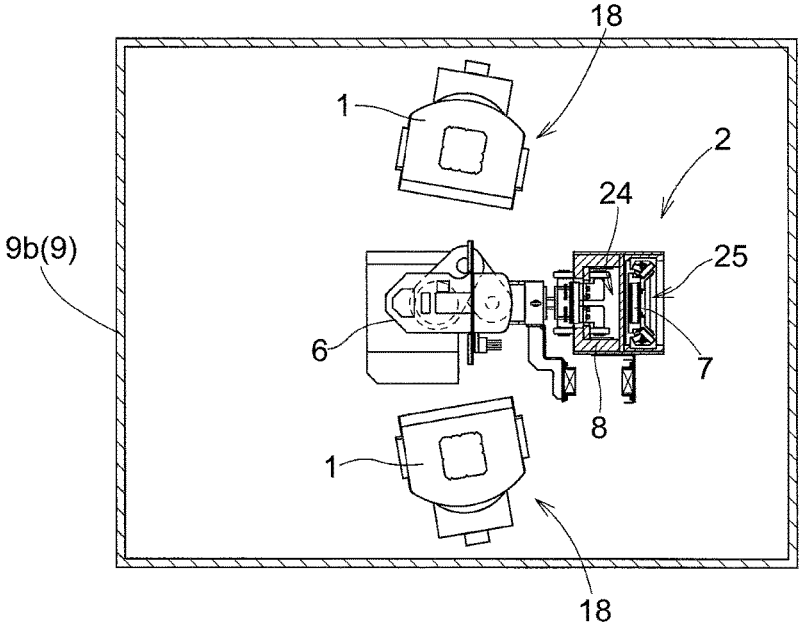
FIG. 4 is a cross-sectional view showing a raising and lowering transport device and a narrow portion of the tubular member.

In addition, as shown in FIGS. 3 and 4, article storage sections 18 for storing articles 1 are provided in both the broad portions 9*a* and the narrow portions 9*b* of the tubular member 9. Therefore, a plurality of articles 1 can be stored in the tubular member 9. When an article 1 is placed at the outside location 12 of a the transport conveyor 14 by the ceiling transport vehicle 3 or the floor transport vehicle 4, the article 1 is transported from the outside location 12 to the inside location 13 by the transport conveyor 14 with the article 1 placed on the transport conveyor 14. After arriving at the inside location 1, the article 1 is transferred from the inside location 13 to an article storage section 18 by the raising and lowering transport device 2 and is thus stored at the article storage section 18. Note that the raising and lowering transport device 2 may also transfer an article 1 from an inside location 13 to another location other than an article storage section 18.

Also, an article 1 stored in an article storage section 18 is transferred by the raising and lowering transport device 2 from the article storage section 18 to the inside location 13 of a transport conveyor 14, and is thereafter transported by the transport conveyor 14 from the inside location 13 to the outside location 12 with the article 1 placed on the transport conveyor 14. The article 1 which has reached the outside location 12 is picked up from the outside location 12 by the ceiling transport vehicle 3 or the floor transport vehicle 4.

Figure 5:
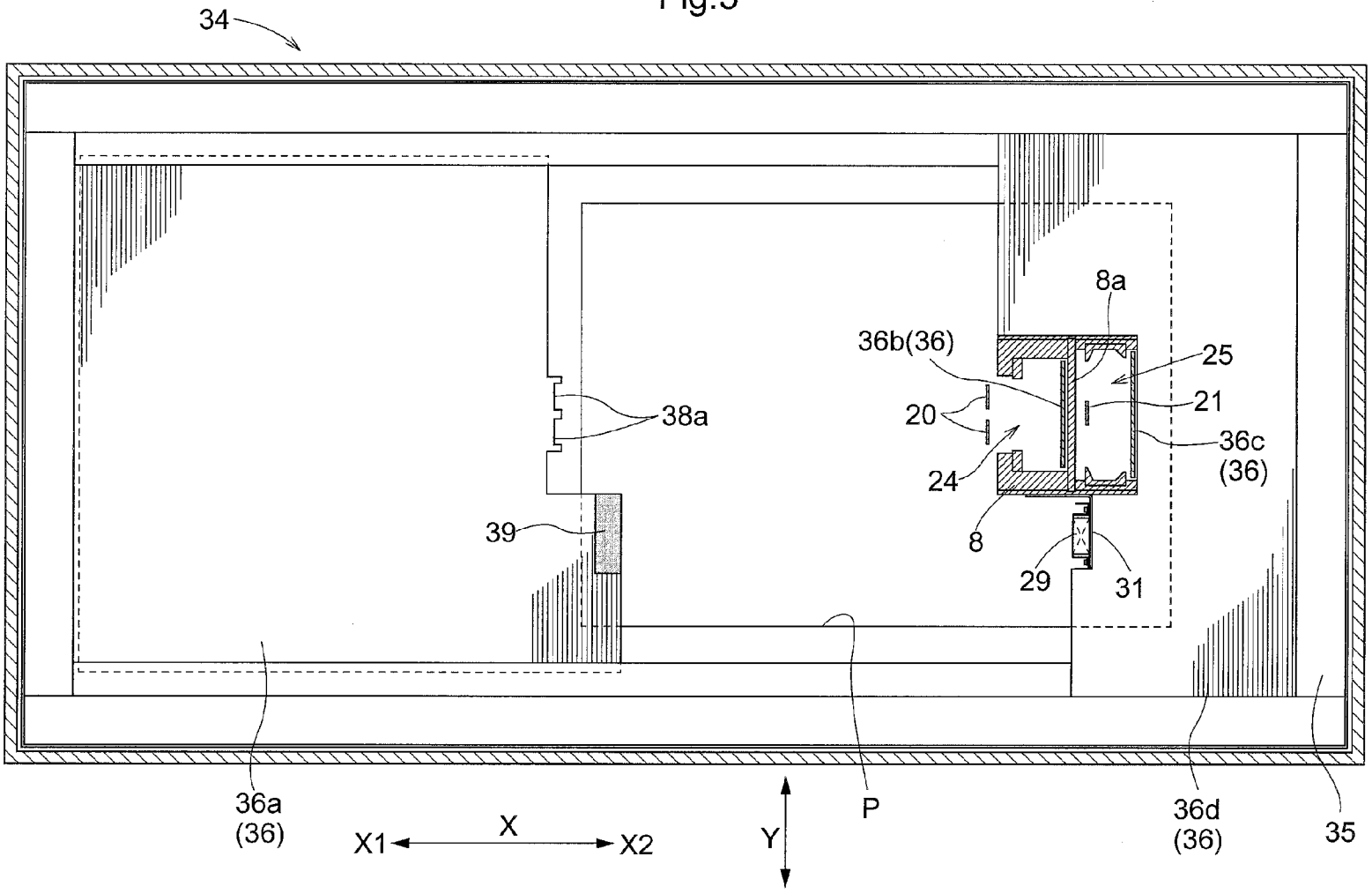
FIG. 5 is a plan view showing the fire door in an open state.
Figure 6:
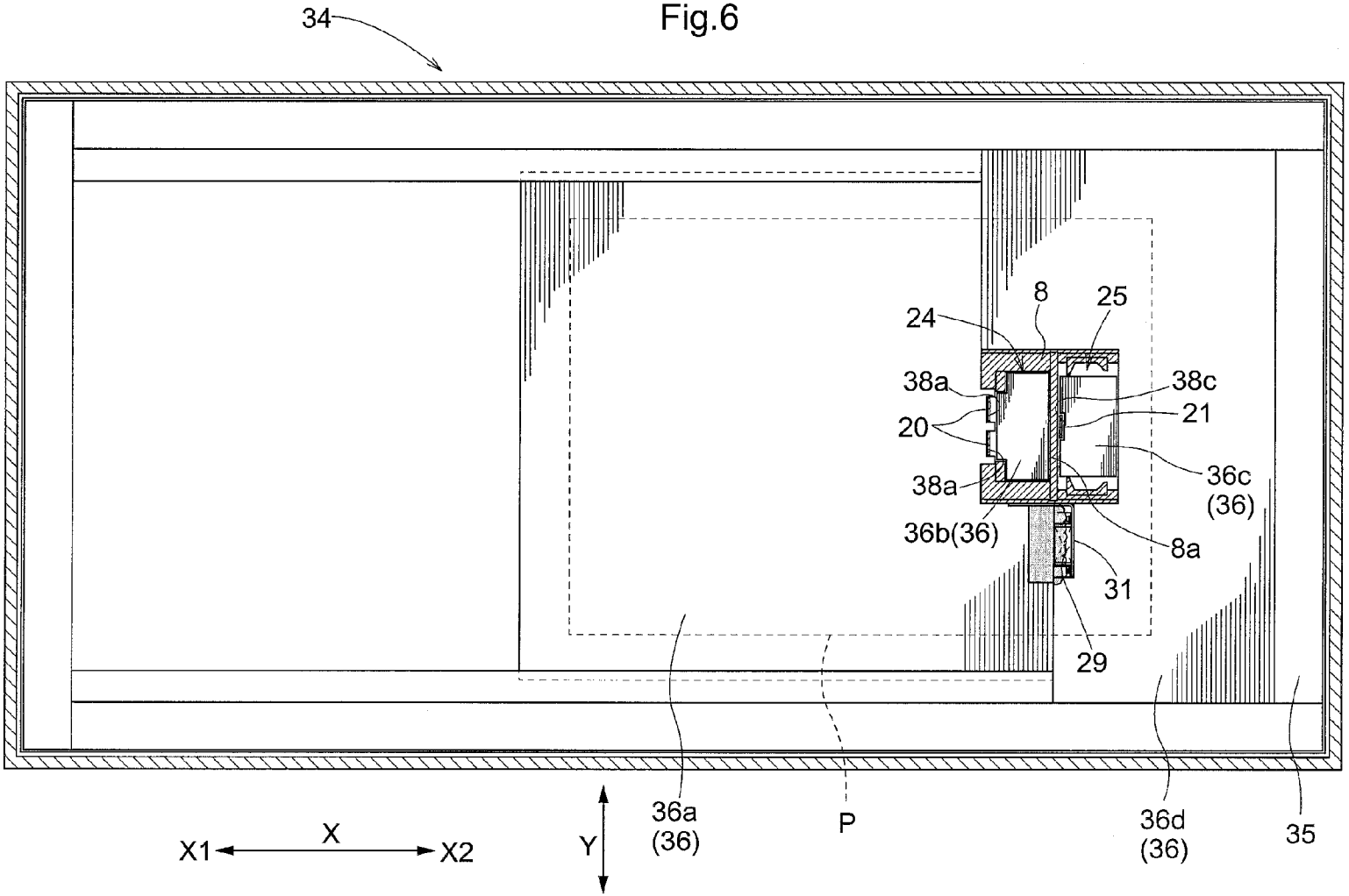
FIG. 6 is a plan view showing the fire door in a closed state.

FIG. 2 is a cross-sectional view showing the raising and lowering transport device 2 whereas FIG. 5 and FIG. 6 are a plan view (i.e., as seen along the vertical direction) of the fire door 34 (whose details will be described below) which can close the opening P. As will be described below, raising and lowering belts 20, 21 are connected to the upper end portion and lower end portion of the raised and lowered member 6 for pulling the raised and lowered member 6 upwardly and downwardly when raising and lowering the raised and lowered member 6. More specifically, upper-side raising and lowering belts 20 (see FIGS. 2, 5, and 6) and a lower-side raising and lowering belt 21 (see FIGS. 5 and 6) are connected to the raised and lowered member 6. Note that, as shown in FIGS. 5 and 6, two upper-side raising and lowering belts 20 are provided whereas one lower-side raising and lowering belt 21 is provided.

The upper-side raising and lowering belt 20 runs over, or are wound around, an upper rotating body (not shown) located above the raising and lowering path of the raised and lowered member 6. As shown in FIG. 2, the one end portion of each upper-side raising and lowering belt 20 is connected to an upper end portion of the raised and lowered member 6 whereas the other end portion of each upper-side raising and lowering belt 20 is connected to an upper end portion of the balance weight 7. In addition, the lower-side raising and lowering belt 21 runs over, or is wound around, a lower rotating body (not shown) provided under the raising and lowering path of the raised and lowered member 6. While not shown, one end portion of the lower-side raising and lowering belt 21 is connected to a lower end portion of the raised and lowered member 6 whereas the other end portion of the lower-side raising and lowering belt 21 is connected to a lower end portion of the balance weight 7. The raised and lowered member 6 is raised and lowered along the raising and lowering path by rotating the upper rotating body in a forward direction and an opposite direction respectively to move the upper-side raising and lowering belt 20 along its longitudinal direction.

As shown for example in FIG. 2, the raised and lowered member 6 and the balance weight 7 are spaced apart from each other with a central portion 8*a* of the guide rail 8 located therebetween in plan view. This direction along which the raised and lowered member 6 and the balance weight 7 are spaced apart from each other in plan view will be referred to as the fore and aft direction X. And the side on which the raised and lowered member 6 is located with respect to the guide rail 8 will be referred to as the front side X1 along the fore and aft direction whereas the side on which the balance weight 7 is located with respect to the guide rail 8 will be referred to as the back side X2 along the fore and aft direction. In addition, the direction that perpendicularly intersects this fore and aft direction X in plan view (on the horizontal plane) will be referred to as the lateral direction Y.

As shown, for example, in FIG. 2, in the tubular member 9, the guide rail 8 is provided such that it is displaced toward the back side X2 along the fore and aft direction from the center along the fore and aft direction X. A raised and lowered member engaging groove 24 (guiding groove) for guiding the raised and lowered member 6 along the vertical direction is formed, along the vertical direction, in a portion, of the guide rail 8, that is on the front side X1 along the fore and aft direction. This raised and lowered member engaging groove 24 is formed such that it is recessed from the front face toward the back of the guide rail 8 (i.e., it is formed such that it is recessed from the front side X1 along the fore and aft direction toward the back side X2 along the fore and aft direction). More specifically, the raised and lowered member engaging groove 24 is formed to have a cross-sectional shape whose dimension, along the lateral direction Y, on the deeper end side is larger than the dimension, along the lateral direction Y, of its communicating portion, or opening, that opens to the outside of the raised and lowered member engaging groove 24.

In addition, a balance weight engaging groove 25 for guiding the balance weight 7 along the vertical direction is formed, along the vertical direction, in a portion, of the guide rail 8, that is on the back side X2 along the fore and aft direction. This balance weight engaging groove 25 is formed such that it is recessed from the rear face of the guide rail 8 toward the front (i.e., it is formed such that it is recessed from the back side X2 along the fore and aft direction toward the front side X1 along the fore and aft direction). More specifically, the balance weight engaging groove 25 is formed to have a cross-sectional shape whose dimension, along the lateral direction Y, on the deeper end side is larger than the dimension, along the lateral direction Y, of the opening to the outside of the balance weight engaging groove 25.

As described above, the upper-side raising and lowering belts 20 and the lower-side raising and lowering belt 21 are spaced apart from each other with the central portion 8*a* of the guide rail 8 located therebetween in plan view. Thus, the raised and lowered member engaging groove 24 is formed on the front side X1 along the fore and aft direction with respect to the central portion 8*a* whereas the balance weight engaging groove 25 is formed on the back side X2 along the fore and aft direction with respect to the central portion 8*a*. The upper-side raising and lowering belts 20 and the lower-side raising and lowering belt 21 extend, or span, between the raised and lowered member 6 and the balance weight 7 with the central portion 8*a* of the guide rail 8 located therebetween.

As shown, for example, in FIG. 2, the portions, of the upper-side raising and lowering belts 20, that are located on the front side X1 along the fore and aft direction with respect to the central portion 8*a* of the guide rail 8, such as the portions at which the upper-side raising and lowering belts 20 are connected to the upper end portion of the raised and lowered member 6, are located on the front side X1 along the fore and aft direction with respect to, and forwardly of, the raised and lowered member engaging groove 24. Also, as shown in FIG. 2, the portions, of the upper-side raising and lowering belts 20, that are located on the back side X2 along the fore and aft direction with respect to the central portion 8*a* of the guide rail 8, such as the portions at which the upper-side raising and lowering belts 20 are connected to the upper end portion of the balance weight 7, are located within the balance weight engaging groove 25.

Similarly, while not shown, the portion, of the lower-side raising and lowering belt 21, that is located on the front side X1 along the fore and aft direction with respect to the central portion 8*a* of the guide rail 8, such as the portion at which the lower-side raising and lowering belt 21 is connected to the lower end portion of the raised and lowered member 6, is located on the front side X1 along the fore and aft direction with respect to, and forwardly of, the raised and lowered member engaging groove 24. Also, as shown in FIGS. 5 and 6, the portion, of the lower-side raising and lowering belt 21, that is located on the back side X2 along the fore and aft direction with respect to the central portion 8*a* of the guide rail 8, such as the portion at which the lower-side raising and lowering belt 21 is connected to the lower end portion of the balance weight 7, is located within the balance weight engaging groove 25.

As shown in FIG. 2, the raised and lowered member 6 has a plurality of raised and lowered member guide rollers 26 which are guided by the raised and lowered member engaging groove 24 of the guide rail 8. The raised and lowered member 6 is raised and lowered along the vertical direction while its displacement along the fore and aft direction X and the lateral direction Y is restricted by the virtue of the fact that the plurality of raised and lowered member guide rollers 26 are in contact with the raised and lowered member engaging groove 24. In addition, the balance weight 7 has a plurality of balance weight guide rollers 27 which are guided by the balance weight engaging groove 25 of the guide rail 8. The balance weight 7 is raised and lowered along the vertical direction while its displacement along the fore and aft direction X and the lateral direction Y is restricted by the virtue of the fact that the plurality of balance weight guide rollers 27 are in contact with the balance weight engaging groove 25.

As shown in FIG. 2, wiring 29, such as electricity supply lines and communication lines, etc., and a ladder 32 for inspecting the facility are supported to outer surfaces of the guide rail 8 in which the raised and lowered member engaging groove 24 and the balance weight engaging groove 25 are formed on the inside. More specifically, the wiring 29 is supported by an outside surface, on one side (i.e., lower side in FIG. 2) along the lateral direction Y, of the guide rail 8 whereas the ladder is supported by its outside surface on the other side (i.e., upper side in FIG. 2). The wiring 29 extends upwardly from the lower floor D, and its longitudinally intermediate portion is fixedly supported at a location on the intermediate floor M. And the longitudinal end portion of the wiring 29 is connected to the raised and lowered member 6. On the intermediate floor M, a support member 30 for supporting the wiring 29 is supported to the one side surface (lower side in FIG. 2) along the lateral direction Y, of the guide rail 8. And the intermediate portion of the wiring 29 is fixed to the support member 30 by means of a fastener 31.

Incidentally, as shown in FIG. 1, a fire door 34 which can open and close the opening P is provided in each of the intermediate floor portions FM (the floor portions F located between the upper floor U and the lower floor D). In the present embodiment, provided as the fire doors 34 are a fire door 34 supported by a top surface (floor of the upper floor U) of the floor portion F of the upper floor U, and a fire door 34 supported by a top surface (floor of the intermediate floor M) of the floor portion F of the intermediate floor M. These fire doors 34 have an identical configuration as fire doors 34 supported by the top surfaces of intermediate floor portions FM. That is, each fire door 34 is provided above and vertically next to the opening P formed in the corresponding intermediate floor portion FM.

Figure 7:
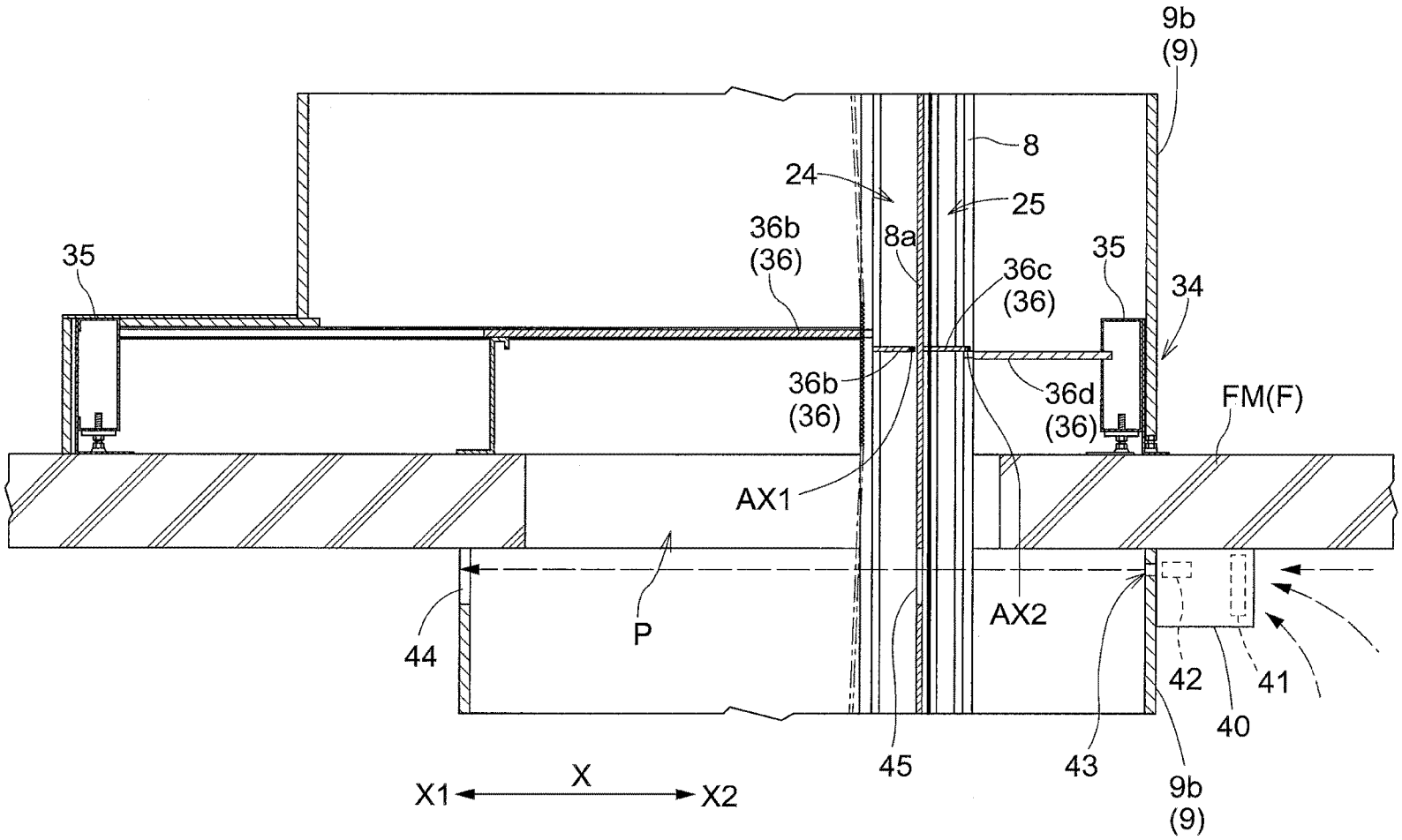
FIG. 7 is a vertical section side view showing the fire door and a gas ejection device.

As described above, FIGS. 5 and 6 are a plan view of the fire door 34. And FIG. 7 is a vertical sectional view of an intermediate floor portion FM equipped with a fire door 34. As shown in FIGS. 5-7, the fire door 34 includes a frame 35 formed in a rectangular shape that surrounds the rectangular opening P, and a plurality of door bodies 36. In the present embodiment, the frame 35 and the plurality of door bodies 36 are made of steel. The plurality of door bodies 36 includes a main door body 36*a*, a raised and lowered member side secondary door body 36*b*, a balance weight side secondary door body 36*c*, and a fixed door body 36*d*. The primary door body 36*a*, the raised and lowered member side secondary door body 36*b*, the balance weight side secondary door body 36*c*, and the fixed door body 36*d* are generally horizontally arranged such that one door body is located horizontally next to another door body (along the fore and aft direction X in the present embodiment).

The primary door body 36*a* closes a portion, of the opening P, that is generally on the front side X1 along the fore and aft direction with respect to the guide rail 8. The raised and lowered member side secondary door body 36*b* closes a portion, of the opening P, that is inside the raised and lowered member engaging groove 24 of the guide rail 8. The balance weight side secondary door body 36*b* closes a portion, of the opening P, that is inside the balance weight engaging groove 24 of the guide rail 8. The fixed door body 36*d* closes a portion, of the opening P, that is generally on the back side X2 along the fore and aft direction with respect to the guide rail 8. In other words, the primary door body 36*a* opens and closes a portion, of the opening P, that is outside the raised and lowered member engaging groove 24. Note that the raised and lowered member side secondary door body 36*b* is, or corresponds to, the secondary door body for opening and closing a portion, of the opening P, that is located inside the raised and lowered member engaging groove 24.

The primary door body 36*a* is arranged such that it can slide horizontally (along the fore and aft direction X) by means of a motor/gear combination or any other known mechanism. The primary door body 36*a* is configured to be switched or moved, by being slid along the fore and aft direction X, between a closed state in which the primary door body 36*a* closes the portion, of the opening P, that is generally on the front side X1 along the fore and aft direction with respect to the guide rail 8 and an open state in which the primary door body 36*a* opens said portion of the opening P. The fixed door body 36*d* is fixed in its closed state in which the fixed door body 36*d* closes the portion, of the opening P, that is generally on the back side X2 along the fore and aft direction with respect to the guide rail 8.

The raised and lowered member side secondary door body 36*b* is arranged to be pivotable about a pivot axis (first pivot axis AX1) which extends along the lateral direction Y and which is located at a position toward the deep end side, which is the back side X2 along the fore and aft direction, of the raised and lowered member engaging groove 24. The raised and lowered member side secondary door body 36*b* is configured to be switched or moved, by being pivoted about the first pivot axis AX1, between a closed state in which the raised and lowered member side secondary door body 36*b* closes the portion, of the opening P, that is inside the raised and lowered member engaging groove 24 and an open state in which the raised and lowered member side secondary door body 36*b* opens said portion inside the raised and lowered member engaging groove 24, by means of a motor/gear combination or any other known mechanism. The raised and lowered member side secondary door body 36*b* is arranged in the raised and lowered member engaging groove 24 such that it strays off the raising and lowering path of the raised and lowered member 6 when the attitude of the raised and lowered member side secondary door body 36*b* is switched, or moved, to the open attitude or the open state.

The balance weight side secondary door body 36*c* is arranged to be pivotable about a pivot axis (second pivot axis AX2) which extends along the lateral direction Y and which is located at a position toward the opening side, which is the back side X2 along the fore and aft direction, of the balance weight engaging groove 25. The balance weight side secondary door body 36*c* is configured to be switched or moved, by being pivoted about the second pivot axis AX2, between a closed state in which the balance weight side secondary door body 36*c* closes the portion, of the opening P, that is inside the balance weight engaging groove 25 and an open state in which the balance weight side secondary door body 36*c* opens said portion inside the balance weight engaging groove 25, by means of a motor/gear combination or any other known mechanism. The balance weight side secondary door body 36*c* is arranged in the balance weight engaging groove 25 such that it strays off the raising and lowering path of the balance weight 7 when the attitude of the balance weight side secondary door body 36*c* is switched, or moved, to the open attitude or the open state.

As shown in FIG. 5, a pair of first recessed portions 38*a* that the pair of upper-side raising and lowering belts 20 fit, or are accommodated, into respectively are formed in the distal end portion of the primary door body 36*a*. As shown in FIGS. 5 and 6, the pair of upper-side raising and lowering belts 20 fit into the pair of first recessed portions 38*a* as the primary door body 36*a* is switched or moved from the open state to the closed state. After the pair of upper-side raising and lowering belts 20 fit into the pair of first recessed portions 38*a*, the primary door body 36*a*, as it is moved to its closed state, pushes the pair of upper-side raising and lowering belts 20 toward the back side X2 along the fore and aft direction. With the primary door body 36*a* having been switched or moved to its closed state, gaps would be formed by the pair of first recessed portions 38*a* between the primary door body 36*a* and the raised and lowered member side secondary door body 36*b*; however, these gaps are closed by the pair of upper-side raising and lowering belts 20.

In addition, as shown in FIG. 6, a second recessed portion 38*c* which the lower-side raising and lowering belt 21 fits into is formed in a distal end portion of the balance weight side secondary door body 36*c*. As shown in FIGS. 5 and 6, the lower-side raising and lowering belt 21 fits into the second recessed portion 38*c* as the balance weight side secondary door body 36*c* is switched or moved from the open state to the closed state. The distal end portion (i.e., end portion near the second recessed portion 38*c*) of the balance weight side secondary door body 36*c* traces an arc as the door body 36*c* is switched or moved to the closed state so that its movement has a component that is downward and toward the front side X1 along the fore and aft direction; therefore, after the lower-side raising and lowering belt 21 fits into the second recessed portion 38*c*, the balance weight side secondary door body 36*c*, as it is switched or moved to the closed state, pushes the lower-side raising and lowering belt 21 toward the front side X1 along the fore and aft direction. With the balance weight side door body 36*c* having been switched or moved to its closed state, a gap would be formed by the second recessed portion 38*c* between the balance weight side door body 36*c* and the guide rail 8; however, this gap is closed by the lower-side raising and lowering belt 21.

Further, as shown in FIGS. 5 and 6, the primary door body 36*a* has an expanding member 39 which expands with heat at a location near the fastener 31 when the primary door body 36*a* is in the closed state. As shown in FIG. 6, with the primary door body 36*a* switched or moved to the closed state, the expanding member 39 expands when exposed to heat so that the gap formed between the primary door body 36*a* and the support member 30 and the fastener 31 is closed off. In other words, the expanding member 39 is provided at a location of an edge of the fire door 34 where a gap may be formed when the opening P is closed by the fire door 34. In the description and claims, the expression "edge of the fire door 34" means an edge or edges of one or more of the components (i.e., door bodies) of the fire door 34.

In the article transport facility 100, the fire door 34 is switched or moved to, and maintained, in the open state (i.e., each door body is closed) during normal operation when articles 1 are transported by the raising and lowering transport device 2. If a fire breaks out on any floor, such as the lower floor D, the fire is detected by a fire detector (not shown). A controller (not shown) for controlling the article transport facility 100 controls, based on the detection information from the fire detector, the raising and lowering transport device 2 to lower the raised and lowered member 6 to the lower floor D. Subsequently, the controller controls the operation of the fire door 34 to switch or move the fire door 34 to the closed state.

Thus, the opening P formed in an intermediate floor portion FM can be closed by switching or moving the fire door 34 to the closed state. However, when there is any gap at an edge of the fire door 34, there is a possibility that smoke etc. created on a floor below may enter the floors above through this gap. The following are potential gaps which may be formed at an edge of the fire door 34 even when the fire door 34 is closed. They include, among other gaps, for example, a gap formed between an edge of the primary door body 36*a* and the guide rail 8 or an edge of the fixed door body 36*d*, a gap formed between an edge of the raised and lowered member side secondary door body 36*b* and the guide rail 8, and a gap formed between the balance weight side secondary door body 36*c* and the guide rail 8.

Figure 8:
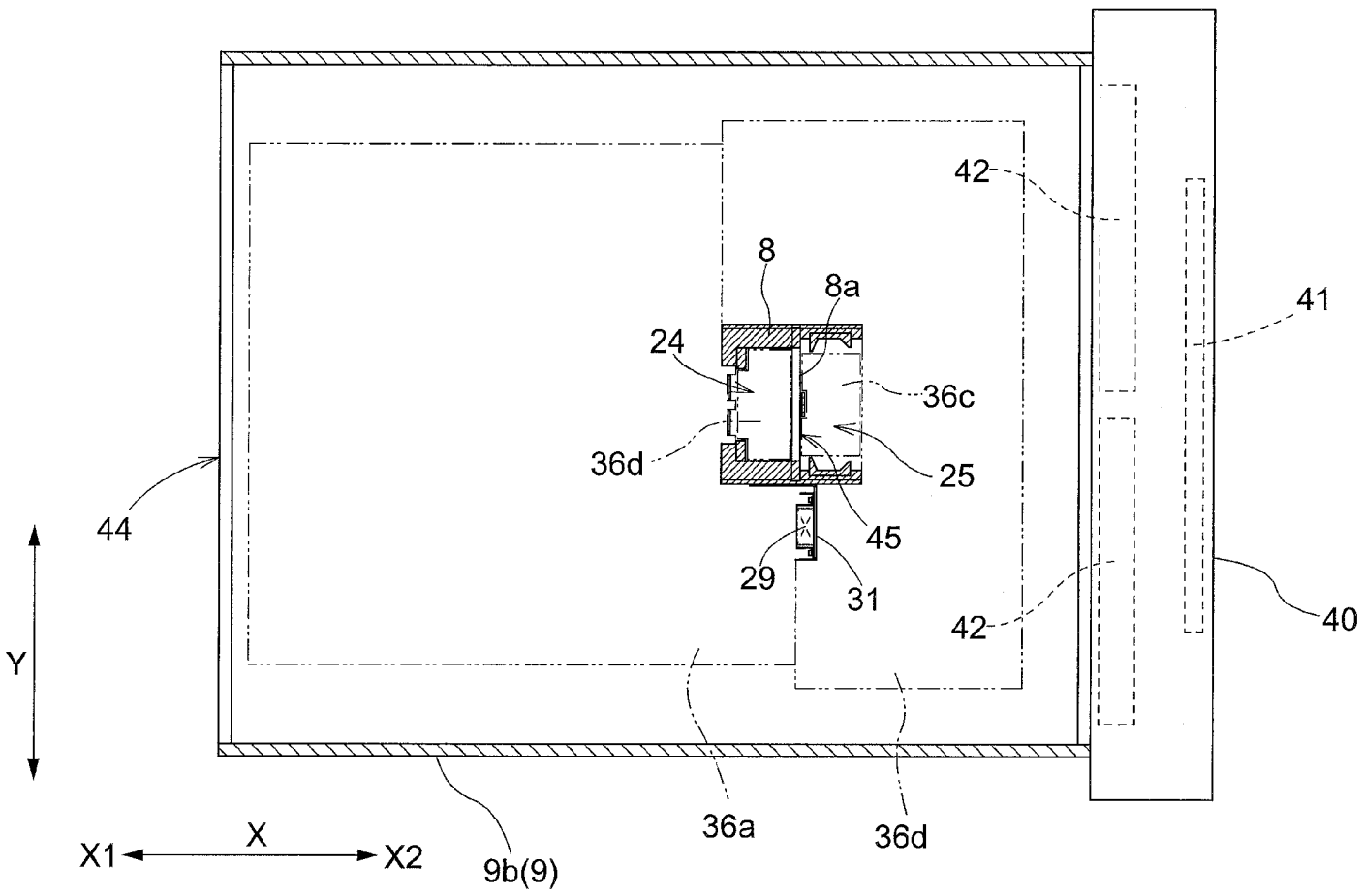
FIG. 8 is a plan view of the gas ejection device.

Regarding this issue, as shown in FIG. 7 and FIG. 8, gas ejection devices 40 are provided to prevent smoke etc. from entering the floors above from the floor below through any gaps formed at an edge of the fire door 34 when the fire door 34 is in the closed state. Each gas ejection device 40 includes an ejecting portion 42 for ejecting air which functions as the gas to be ejected.

A plurality of gas ejection devices 40 are provided and it is preferable that one gas ejection device 40 is supported by the undersurface of each intermediate floor portion FM (the ceiling surface of each intermediate floor M and the ceiling surface of the lower floor D). In the present embodiment, one gas ejection device 40 is supported by the undersurface of the floor portion F of the upper floor U (ceiling surface of the intermediate floor M) and another gas ejection device 40 is supported by the undersurface of the floor portion F of the intermediate floor M (ceiling surface of the lower floor D). These gas ejection devices 40 have the same structure and configuration. And each gas ejection device 40 is provided below (i.e., at a lower position than), and close to, the opening P formed in the intermediate floor portion FM. In other words, in the present embodiment, in addition to the fire door 34, a gas ejection device 40 is provided for each opening P. And each gas ejection device 40 is provided below and close to the opening P and thus below the fire door 34. In other words, each gas ejection device 40 is provided on the floor below whose ceiling is the intermediate floor portion FM in which the fire door 34 is provided.

As shown in FIGS. 7 and 8, each gas ejection device 40 is located toward the back side X2 along the fore and aft direction with respect to the opening P. In the present embodiment, each gas ejection device 40 is provided outside the tubular member 9 (and on the back side X2 along the fore and aft direction with respect to the tubular member 9). In addition, the gas ejection device 40 includes an intake portion 41 for taking in air, and the ejecting portion 42 for ejecting the air taken in by the intake portion 41. Either one or both of the intake portion 41 and the ejecting portion 42 may have a motor-driven fan or any known mechanism for moving air. The intake portion 41 draws in air from space on the opposite side from the side on which the raising and lowering path of the raised and lowered member 6 exists with respect to the gas ejection device 40 (i.e., from space on the back side X2 along the fore and aft direction with respect to the gas ejection device 40). The ejecting portion 42 ejects air horizontally toward the side on which the raising and lowering path of the raised and lowered member 6 exists with respect to the gas ejection device 40 (i.e., toward front side X1 along the fore and aft direction with respect to the gas ejection device 40). An ejection opening through which the ejecting portion 42 ejects gas and an external wall surface of the tubular member 9 that faces the ejection opening (i.e., surface of a wall, of the tubular member 9, on the back side X2 along the fore and aft direction) are located close to each other, and, more preferably, are in, or nearly in, sealing contact with each other. In addition, a gas flow opening 43 for guiding or allowing the gas ejected from the ejecting portion 42 into the tubular member 9 is provided in the surface of the wall that faces, or is oriented toward, the ejecting portion 42.

The ejecting portion 42 is configured such that air is ejected to form a belt-shaped flow of air which is generally vertically thin and broad along the lateral direction Y. The width of the belt-shaped flow of air formed by the ejecting portion 42 as it ejects air is greater than the width of the door body 36 along the lateral direction Y. In other words, the ejecting portion 42 is provided such that it ejects air over the entire width of the door body 36 along the lateral direction Y. That is, the ejecting portion 42 of the gas ejection device 40 ejects air along a horizontal direction (fore and aft direction X) toward an area directly below any gap formed at an edge of the fire door 34 when the opening P is closed by the fire door 34. The ejected air (ejected gas) blows away raising hot air or smoke etc. horizontally before the smoke etc. reaches the gap so that the smoke etc. would not enter the floors above through the gap.

In addition, the tubular member 9 has a tubular member gas passage opening 44 for allowing gas to flow from inside of the tubular member 9 to its outside. In the present embodiment, the tubular member gas passage opening 44 is disposed below each intermediate floor portion FM. This tubular member gas passage opening 44 is provided to, or formed in, the tubular member 9 on the front side X1 along the fore and aft direction (downstream side of the direction in which the ejecting portion 42 ejects gas). More specifically, the tubular member gas passage opening 44 consists of a through hole which is formed at the same height as the ejecting portion 42 and which is formed in a portion which defines the surface, of the tubular member 9, that is on the front side X1 along the fore and aft direction (i.e., front surface of the surfaces that form the tube). In other words, the tubular member gas passage opening 44 provided in the tubular member 9 is located directly in front of the ejecting portion 42 in a horizontal direction (fore and aft direction X). As described above, the gas flow opening 43 is provided in the tubular member 9. The tubular member gas passage opening 44 is formed at the same height as this gas flow opening 43 as well. The gas ejected from the ejecting portion 42 flows through and past the gas flow opening 43, and the area directly below the opening P (which includes areas directly below any gap formed at the edge of the fire door 34 when the opening P is closed), and the tubular member gas passage opening 44.

Similarly, the guide rail 8 also has a guide rail gas passage opening 45 for allowing gas to flow in the fore and aft direction X (the direction in which the ejecting portion 42 ejects gas). This rail gas passage opening 45 consists of a through hole which is provided at the same height as the ejecting portion 42 and in a portion (central portion 8*a*) of the guide rail 8 that is located between the raised and lowered member engaging groove 24 and the balance weight engaging groove 25. In other words, the guide rail gas passage opening 44 provided in the guide rail 8 is located directly in front of the ejecting portion 42 in a horizontal direction (fore and aft direction X).

The gas ejected, horizontally (fore and aft direction X) toward an area directly below any gap formed at an edge of the fire door 34, from the ejecting portion 42 flows from inside the tubular member 9 to the outside thereof through the gas flow opening 43, the guide rail gas passage opening 45, and the tubular member gas passage opening 44. Thus, even if smoke etc. raises up inside the tubular member 9, the smoke etc. can be blown off to outside the tubular member 9 so that smoke etc. would not raise through the gap beyond the intermediate floor portion FM. In other words, by ejecting gas toward an area directly under any gap formed at an edge of the fire door 34, the raising of the smoke etc. is prevented by this flow of gas to prevent the smoke etc. from entering the floors above through the gap. In addition, because the air ejected from the ejecting portion 42 of the gas ejection device 40 flows through the tubular member gas passage opening 44 and the guide rail gas passage opening 45, it is less likely for the flow of air to be disrupted inside the the tubular member 9. Therefore, it becomes easier to prevent the rise of smoke etc. and thus to reliably prevent smoke etc. from entering the floors above through the gap.

Alternative Embodiments (1) In the description above, an example is described in which the gas ejection device 40 includes the intake portion 41 which draws in air from the back side (i.e., back side X2 along the fore and aft direction). However, the intake portion 41 may draw in air from above (i.e. from space between the floor portion F and the gas ejection device 40) of the gas ejection device 40, or from below.

(2) Also, in the description above, an example is described in which air is ejected from the ejecting portion 42 such that a layer of air which is laterally broader than the lateral width of the opening P is formed. However, the lateral width of the layer of air may be changed suitably. For example, air may be ejected from the ejecting portion 42 such that a layer of air is formed which has a lateral width which is approximately equal to the sum of the lateral width of the guide rail 8 and the lateral width of the support member 30 so that air is ejected only to the area around the guide rail 8 and the area around the wiring 29 in the area of the opening P in plan view.

(3) In the description above, an example is described in which air is ejected from the ejecting portion 42. However, inactive gas, such as nitrogen gas, may be ejected from the ejecting portion 42.

(4) In the description above, an example is described in which the fire door 34 includes four door bodies 36, namely, the primary door body 36*a*, the raised and lowered member side secondary door body 36*b*, the balance weight side secondary door body 36*c*, and the fixed door body 36*d*. However, the fire door 34 may include three or less number of door bodies 36 or five or more door bodies 36. For example, the number of the door bodies 36 may be reduced by not providing the balance weight side secondary door body 36*c* so that inside the balance weight engaging groove 25 would not be closed. In addition, the number of the door bodies 36 may be increased by replacing the primary door body 36*a* with a first door body and a second door body so that the area closed by the primary door body 36*a* would be closed by the first door body and the second door body.

(5) In addition, the configuration of how the fire door 34 is opened and closed may also be changed suitably. For example, the primary door body 36*a* may be configured to be rolled up to switch or move it to the closed state and to be fed out to switch or move it to the open state. In addition, the balance weight side secondary door body 36*c* may be configured to slide to switch or move it between the closed state and the open state.

(6) In the description above, an example is described in which an expanding member 39 is provided at a location of an edge of the fire door 34 to close a gap formed between the end of the fire door 34 and the wiring 29. However, when the smoke, etc. can be prevented from entering through this gap with the use of the gas ejection device 40, for example, then it is not necessary to provide the expanding member 39.

(7) In addition, in the description above, an example is described in which the tubular member 9 is provided which surrounds the raising and lowering path of the raised and lowered member 6. However, if, for example, there is no need to maintain the raising and lowering path of the raised and lowered member 6 in a clean environment, it is not necessary to provide the tubular member 9.

(8) Also, in the description above, an example is described in which the guide rail 8 for guiding the raised and lowered member 6 is provided; however, if, for example, an extendable arm is provided which can extend and contract vertically and has a distal end portion for supporting the raised and lowered member 6 so that the raised and lowered member 6 is raised and lowered by extending and contracting the extendable arm, then it is not necessary to provide the guide rail 8.

(9) In the description above, an example is described in which the gas ejection device 40 is provided outside the tubular member 9 (on the back side X2 along the fore and aft direction with respect to the tubular member 9) and in which the gas flow opening 43 for guiding or allowing the gas ejected from the ejecting portion 42 into the tubular member 9 is formed or provided in the external wall surface, of the tubular member 9, that faces, or is oriented toward, the ejecting portion 42. However, this does not preclude the arrangement in which the gas ejection device 40 is provided inside the tubular member 9. In this case, it is preferable that the gas flow opening 43 is provided in the inner surface of back wall of the tubular member 9 so as to face, or be oriented toward, the intake portion 41 of the gas ejection device 40.

[Brief Summary of Article Transport Facility]

A brief summary of the article transport facility described above is provided next.

In one embodiment, the article transport facility comprises: an article transport device for raising and lowering a raised and lowered member for supporting an article, through a plurality of floors; an opening which is formed in an intermediate floor portion, and which the raised and lowered member can move through in a vertical direction, the intermediate floor portion being a floor portion located between an uppermost floor and a lowermost floor of the plurality of floors; a fire door for opening and closing the opening; and a gas ejection device having an ejecting portion for ejecting gas; wherein the gas ejection device is provided at a lower position than the fire door, and wherein the ejecting portion ejects gas horizontally toward an area directly below a gap formed at an edge of the fire door when the opening is closed by the fire door.

With the arrangement described above, the gas ejected by the ejecting portion is ejected horizontally toward an area directly below the gap formed at an edge of the fire door. And the flow of gas ejected by the ejecting portion makes it difficult for the smoke etc. to raise above the area of the flow of gas; thus, smoke etc. can be prevented from entering the floor above through the gap located directly above the flow of gas. Note that in order to prevent the rise of smoke etc. effectively, it is preferable that the strength of the flow (of gas ejected from the gas ejection device) in the area directly below the gap is greater than the strength of the flow of rising flow caused by the smoke etc.

In addition, the gas ejection device preferably has an intake portion for drawing in air from a floor below the fire door, and the ejecting portion preferably ejects the air drawn in through the intake portion.

With the arrangement described above, the gas ejection device draws in air of the floor below through the intake portion, and ejects air from the ejecting portion. It is conceivable that air on the floor below may have a lower oxygen content because of the fire that has broken out. By ejecting such air with relatively low oxygen content from the ejecting portion, smoke etc. can be prevented from entering the floor above through any gap while preventing the fire from becoming more intense.

Also, a tubular member is preferably further provided for defining a raising and lowering path along which the raised and lowered member is raised and lowered, the tubular member being formed in a shape that surrounds the raising and lowering path, wherein the tubular member preferably has a tubular member gas passage opening for allowing gas to flow from inside the tubular member to outside, and access openings for transferring articles with each access opening being formed for corresponding one of the plurality of floors, and wherein the tubular member gas passage opening is preferably provided in the tubular member at a location downstream in a direction in which the ejecting portion ejects gas.

With the arrangement described above, articles can be transported by the article transport device through the plurality of floors such that each article carried in through an access opening is transported by the article transport device, and is taken out from another access opening. And it is necessary to maintain the environment of the travel path in a clean environment when the article transport device, for example, transports containers for holding holds substrates, such as semiconductor substrates, as articles. To this end, since only the interior of the tubular member needs to be kept locally clean, the arrangement above makes it easier to create and maintain the environment for transporting articles with the article transport device in an environment suitable for the articles.

And when the tubular member is provided in this manner, the gas which is ejected from the ejecting portion of the gas ejection device and which has flown through the area directly under the gap would disturb the flow when it hits the inner surface of the tubular member. Thus, there is a possibility that smoke etc. cannot be properly prevented from flowing through the gap. However, by providing the tubular member gas passage opening in the tubular member at a location downstream in a direction in which the ejecting portion ejects gas, the gas which has flown through the area directly under the gap can flow through the tubular member gas passage opening and is allowed to flow to the outside of the tubular member. This arrangement can reduce the disturbance of the flow of the gas ejected from the ejecting portion, making it easier to properly prevent smoke etc. from flowing through the gap. Also, disturbance in the flow of the gas ejected from the ejecting portion can be reduced more effectively by providing the tubular member passage opening to the tubular member at a location directly in front of the ejecting portion.

When the tubular member gas passage opening is provided in the tubular member at a location downstream in a direction in which the ejecting portion ejects gas, the gas ejection device is preferably located outside the tubular member with the ejecting portion directed toward a wall surface of the tubular member, and wherein a gas flow opening for allowing gas ejected from the ejecting portion into the tubular member is preferably formed in the wall surface, of the tubular member, that is oriented toward the ejecting portion.

With the arrangement described above, gas is ejected by the ejecting portion from outside the tubular member and into the tubular member through the gas flow opening. And The ejected gas is discharged from inside the tubular member to the outside through the tubular member gas passage opening. That is, gas is allowed to flow through the area directly under the gap while more effectively reducing the disturbance in the flow of the gas ejected from the ejecting portion. Therefore, smoke etc. can be more effectively prevented from entering into the floor above through the gap.

In addition, a guide rail for guiding the raised and lowered member is preferably provided such that the guide rail extends inclusively between the uppermost floor and the lowermost floor and through the opening wherein the guide rail preferably has a guide rail gas passage opening for allowing gas to flow in a direction in which the ejecting portion ejects gas.

With the arrangement described above, since the raised and lowered member is raised and lowered while being guided by the guide rail, the raised and lowered member can be raised and lowered properly along the raising and lowering path. And when the guide rail is provided in this manner, the gas which is ejected from the ejecting portion of the gas ejection device would disturb the flow when it hits the guide rail. Thus, there is a possibility that smoke etc. cannot be properly prevented from flowing through the gap. By providing the guide rail with the guide rail gas passage opening for allowing gas to flow in a direction in which the ejecting portion ejects gas, the gas can flow through the guide rail gas passage opening. This arrangement can reduce the disturbance in the flow of the gas ejected from the ejecting portion, making it easier to properly prevent smoke etc. from flowing through the gap. Also, disturbance in the flow of the gas ejected from the ejecting portion can be reduced more effectively by providing the guide rail gas passage opening to the guide rail at a location directly in front of the ejecting portion.

Also, the guide rail preferably has a guiding groove for guiding the raised and lowered member along the vertical direction, wherein the guiding groove is preferably formed to have a shape whose lateral dimension on a horizontally deep end side is larger than a lateral dimension of a communicating portion thereof which opens to outside of the guiding groove, wherein the fire door preferably includes a secondary door body for opening and closing a portion, of the opening, that is located within the guiding groove, and a primary door body for opening and closing a portion, of the opening, that is located outside the guiding groove.

With the arrangement described above, by closing, with the secondary door body, the portion of the opening that is located within the guiding groove, and by closing, with the primary door body, the portion of the opening that is located outside the guiding groove, it becomes easier to make smaller the gap formed between an edge of the door for opening and closing the opening and the guide rail, compared to closing the opening with a single door body.

In addition, a raising and lowering belt is preferably connected to an upper end portion and to an lower end portion of the raised and lowered member, for pulling the raised and lowered member upward and downward when raising and lowering the raised and lowered member respectively, wherein a recessed portion for the raising and lowering belt to fit into is preferably formed at the edge of fire door that faces the raising and lowering belt when the opening is closed by the fire door, and wherein the recessed portion is preferably closed by the raising and lowering belt when the opening is closed by the fire door.

A raising and lowering belt is sometimes connected to the raised and lowered member to smoothly raise and lower the raised and lowered member. Such a raising and lowering belt extends through the plurality of floors through the opening provided in the intermediate floor portion. As such, when the opening is closed by the fire door, the raising and lowering belt may be caught between the fire door and the opening, possibly forming an undesired gap. However, with the arrangement described above, the recessed portion for the raising and lowering belt to fit into is formed at the edge of fire door; thus, such an undesired gap is not formed even when the opening is closed by the fire door. In addition, the recessed portion is closed by the raising and lowering belt when the opening is closed by the fire door. Therefore, even when such a raising and lowering belt is provided, undesired gap would not be formed when the opening is closed by the fire door so that smoke etc. can be effectively prevented from entering the floor above through such a gap.

And, an expanding member which expands when heated is provided at a location of the edge of the fire door where a gap is preferably formed when the opening is closed by the fire door.

With the arrangement described above, since any gap formed in at an edge of the fire door is physically closed by the expanding member, flame and/or smoke, etc. generated by the fire on the floor below, can be prevented from entering the floor above through the gap.

What is claimed is:

1. An article transport facility comprising:

an article transport device for raising and lowering a raised and lowered member for supporting an article, through a plurality of floors;

a guide rail for guiding the raised and lowered member;

an opening which is formed in an intermediate floor portion, and which the raised and lowered member can move through in a vertical direction, the intermediate floor portion being a floor portion located between an uppermost floor and a lowermost floor of the plurality of floors;

a fire door for opening and closing the opening; and a gas ejection device having an ejecting portion for ejecting gas;

wherein the gas ejection device is provided at a lower position than the fire door, and wherein the ejecting portion ejects gas horizontally toward an area directly below a gap formed at an edge of the fire door when the opening is closed by the fire door; and wherein the guide rail extends inclusively between the uppermost floor and the lowermost floor and through the opening, and has a guide rail gas passage opening for allowing gas to flow in a direction in which the ejecting portion ejects gas.

2. The article transport facility as defined in claim 1, wherein the gas ejection device has an intake portion for drawing in air from a floor below the fire door, and wherein the ejecting portion ejects the air drawn in through the intake portion.

3. The article transport facility as defined in claim 2, further comprising a hollow member for defining a raising and lowering path along which the raised and lowered member is raised and lowered, the hollow member being formed in a shape that surrounds the raising and lowering path, wherein the hollow member has a hollow member gas passage opening for allowing gas to flow from inside the hollow member to outside, and access openings for transferring articles with each access opening being formed for a corresponding one of the plurality of floors, and wherein the hollow member gas passage opening is provided in the hollow member at a location downstream in a direction in which the ejecting portion ejects gas.

4. The article transport facility as defined in claim 3, wherein the gas ejection device is located outside the hollow member with the ejecting portion directed toward a wall surface of the hollow member, and wherein a gas flow opening for allowing gas ejected from the ejecting portion into the hollow member is formed in the wall surface, of the hollow member, that is oriented toward the ejecting portion.

5. The article transport facility as defined in claim 4, wherein a raising and lowering belt is connected to an upper end portion and to an lower end portion of the raised and lowered member, for pulling the raised and lowered member upward and downward when raising and lowering the raised and lowered member respectively, wherein a recessed portion for the raising and lowering belt to fit into is formed at the edge of the fire door that faces the raising and lowering belt when the opening is closed by the fire door, and wherein the recessed portion is closed by the raising and lowering belt when the opening is closed by the fire door.

6. The article transport facility as defined in claim 5, wherein the guide rail has a guiding groove for guiding the raised and lowered member along the vertical direction, wherein the guiding groove is formed to have a shape whose lateral dimension on a horizontally deep end side is larger than a lateral dimension of a communicating portion thereof which opens to outside of the guiding groove, and wherein the fire door includes a secondary door body for opening and closing a portion, of the opening, that is located within the guiding groove, and a primary door body for opening and closing a portion, of the opening, that is located outside the guiding groove.

7. The article transport facility as defined in claim 6, wherein an expanding member which expands when heated is provided at a location of the edge of the fire door where a gap is formed when the opening is closed by the fire door.

8. The article transport facility as defined in claim 3, wherein the guide rail is arranged in the hollow member and apart from a wall surface of the hollow member.

9. The article transport facility as defined in claim 1, further comprising a hollow member for defining a raising and lowering path along which the raised and lowered member is raised and lowered, the hollow member being formed in a shape that surrounds the raising and lowering path, wherein the hollow member has a hollow member gas passage opening for allowing gas to flow from inside the hollow member to outside, and access openings for transferring articles with each access opening being formed for a corresponding one of the plurality of floors, and wherein the hollow member gas passage opening is provided in the hollow member at a location downstream in a direction in which the ejecting portion ejects gas.

10. The article transport facility as defined in claim 9, wherein the gas ejection device is located outside the hollow member with the ejecting portion directed toward a wall surface of the hollow member, and wherein a gas flow opening for allowing gas ejected from the ejecting portion into the hollow member is formed in the wall surface, of the hollow member, that is oriented toward the ejecting portion.

11. The article transport facility as defined in claim 9, wherein the guide rail is arranged in the hollow member and apart from a wall surface of the hollow member.

12. The article transport facility as defined in claim 1, wherein the guide rail has a guiding groove for guiding the raised and lowered member along the vertical direction, wherein the guiding groove is formed to have a shape whose lateral dimension on a horizontally deep end side is larger than a lateral dimension of a communicating portion thereof which opens to outside of the guiding groove, and wherein the fire door includes a secondary door body for opening and closing a portion, of the opening, that is located within the guiding groove, and a primary door body for opening and closing a portion, of the opening, that is located outside the guiding groove.

13. The article transport facility as defined in claim 1, wherein a raising and lowering belt is connected to an upper end portion and to an lower end portion of the raised and lowered member, for pulling the raised and lowered member upward and downward when raising and lowering the raised and lowered member respectively, wherein a recessed portion for the raising and lowering belt to fit into is formed at the edge of fire door that faces the raising and lowering belt when the opening is closed by the fire door, and wherein the recessed portion is closed by the raising and lowering belt when the opening is closed by the fire door.

14. The article transport facility as defined in claim 1, wherein an expanding member that expands under heat is provided at a location of the edge of the fire door where a gap is formed when the opening is closed by the fire door.

15. The article transport facility as defined in claim 1, wherein the guide rail includes a first guiding groove for guiding the raised and lowered member along the vertical direction; a second guiding groove for guiding a counter weight connected to the raised and lowered member along the vertical direction; and wherein a central portion extends along the vertical direction between the first guiding groove and the second guiding groove, and the guide rail gas passage opening is formed in the central portion.

* * * * *